United States Patent [19]

Seippel et al.

[11] 3,953,148

[45] Apr. 27, 1976

[54] CONFIGURATION OF THE LAST MOVING BLADE ROW OF A MULTI-STAGE TURBINE

[75] Inventors: Claude Seippel; Arnulf Teufelberger, both of Zurich, Switzerland

[73] Assignee: BBC Brown Boveri & Company Limited, Baden, Switzerland

[22] Filed: Apr. 26, 1974

[21] Appl. No.: 464,678

[30] Foreign Application Priority Data

Apr. 30, 1973 Switzerland ..... 6096/73

[52] U.S. Cl. ..... 415/199 R; 415/194

[51] Int. Cl.[2] ..... F01D 1/02

[58] Field of Search ..... 415/190, 191, 192, 193, 415/194, 195, 199, 185

[56] References Cited

UNITED STATES PATENTS

| | | | |
|---|---|---|---|
| 925,065 | 6/1909 | Wilstam | 415/194 |
| 1,390,733 | 9/1921 | Spiess | 415/185 |
| 1,475,213 | 11/1923 | Wirt | 415/194 |
| 1,526,814 | 2/1925 | Warren | 415/191 |
| 1,771,023 | 7/1930 | Allen | 415/192 |
| 2,224,519 | 12/1940 | McIntyre | 415/192 |
| 2,258,792 | 10/1941 | New | 415/194 |

*Primary Examiner*—Henry F. Raduazo
*Attorney, Agent, or Firm*—Pierce, Scheffler & Parker

[57] ABSTRACT

A multi-stage axial-flow turbine structure where in order to reduce the energy content of the gaseous working medium leaving the last moving blade row in comparison to the available heat drop, the flow discharge cross-section area from the last moving row, compared to the flow discharge cross-section area of the penultimate moving row, is made larger by some 10 to 40 % than would correspond to the ratio of the increase in volume of the working medium from the penultimate to the last moving blade now. This is accomplished, for example, by increasing the ratio of the passage width to blade pitch and/or by increasing the annular flow area, this ratio being varied over the length of the blades of the last row in order to obtain a uniform velocity profile in the axial and tangential directions. The desired result can also be obtained by making the flow discharge cross-section area of all moving blade rows preceding the last row smaller by an amount corresponding to the reduction in heat drop of the last moving blade row brought about by enlarging its cross-section area such as by decreasing the ratio of passage width to blade pitch and/or by reducing the annular flow area.

7 Claims, 5 Drawing Figures

CONFIGURATION OF THE LAST MOVING BLADE ROW OF A MULTI-STAGE TURBINE

The invention concerns a turbine of axial construction through which a compressible working medium flows and which has at least two stages, each comprising one fixed blade row and one moving blade row.

High efficiency, economic operation and reliability are the most important criteria to be considered by the turbine designer. Low cost and reliability are achieved with turbines having few stages. Increasing the numer of stages undoubtedly leads to better efficiencies, but at the same time, owing to the consequently greater length of the machine, to higher costs and also in general to poorer reliability.

A known method of optimization in the design of turbomachines (book by Dzung "Flow Research On Blading", Elsevier Publishing Company, Amsterdam, 1970, p. 26 – 28), the aim of which is to reduce the axial extent of the blading and hence shorten the overall length of the machine, is the application of the Mehldahl criterion $M_L$, which in the particularly important case of the reaction turbine (50 % reaction, symmetrical fixed and moving blade rows) is expressed as follows:

$$M_L = \left[\frac{b^2 \cdot t}{W} \quad \frac{\sqrt{1+4\nu^2}}{\mu \cdot \nu^2}\right]^{1/2}$$

Here, $b$ width of row perpendicular to plane of row $t$ blade pitch

W moment of resistance of blade profile $\nu$ ratio of axial flow velocity to peripheral velocity $\mu$ ratio of the change in tangential velocity on passing through the blade row to the peripheral velocity.

It is the objective of the turbine designer to achieve the smallest possible value of $M_L$ for the highest possible efficiency.

For a machine of predetermined speed, the mean diameter of a stage is defined on the basis of technical and economic considerations. The Mehldahl coefficient $M_L$ can be influenced by adopting the following measures:

1. Smallest possible ratio $(b^2 . t)/W$. For a prescribed maximum load capacity of the blade material, the bending forces on the blading necessitate a specified moment of resistance proportional to the blade pitch. A small ratio $(b^2 . t)/W$ results in blade profiles which are thick compared to the chord (e.g. blade profiles 10 in FIG. 2 described below). According to present knowledge they nevertheless achieve good efficiencies and allow small row widths $b$, and hence short blade assemblies.

2. Raising the axial flow velocity leads to smaller blade heights. Both the tangential forces, which remain the same, and also the axial forces, which for the same pressure drop become smaller owing to the smaller area of impingement, act on a shorter cantilever. The reduced bending moments allow narrower blade rows, and thus result in a shorter turbine.

3. A measure often employed is to increase the tangential change in velocity on passing through the blade row in order to increase the stage drop. For a given peripheral velocity this has the effect of reducing the number of stages. The bending moment on the individual blades, however, is greater so that the individual rows are somewhat wider, but the influence of the number of stages predominates when considering the length of the machine.

In the construction of turbines it is usual that for a group of stages designed according to optimization methods, the increase in flow cross-section area from one stage to the next is roughly equivalent to the volume increase of the flow medium, or less. The flow velocities therefore remain the same from one stage to the next, or they increase. The kinetic energy available at the outlet from a stage, i.e. that which has not been converted into mechanical work, will to a considerable extent (60 % or more) be utilized in the following stage, provided the stage is not the last.

A disadvantage is that the kinetic energy available at the exit from the last moving row, at least that of the tangential velocity component, can be utilized to only a small extent in a diffuser. With static installations there is usually no space for a good diffuser, and so one has to accept the total loss of the leaving energy.

The object of the invention is to reduce the leaving energy from the last moving row in comparison to the available heat drop.

This object is achieved in that the flow discharge cross-section area from the last moving row, compared to the flow discharge cross-section area of the penultimate moving row, is larger by some 10 to 40 % than would correspond to the ratio of the increasing volume of the flow medium.

Through reducing the leaving losses, the configuration of the last moving row in accordance with the invention results in a higher turbine efficiency.

The flow discharge cross-section area of the last moving row is enlarged by increasing the ratio of passage width $q$ to blade pitch $t$, which is equivalent to enlarging the blade angle, and/or by increasing the annular flow area, which means lengthening the blades and altering one or both of the diameters defining the annular area.

In the case of rows with long blades, such as employed for handling large flow volumes, attention must also be paid to the fact that the leaving velocities along the blade vary in both the tangential and axial direction. In the tangential direction because of the different rotational velocities of the blade sections, in the axial direction because the creation of the equilibrium of forces distorts the three-dimensional flow in rows of very long blades. Instead of altering the leaving angle of the last blade row uniformly over the whole length of the blade, it can be varied from section to section along the blade in such a way that the velocity is not only reduced in total, but also that its profile is smoothed in axial and tangential directions. However, this requires blades with twisted profiles, and these are expensive. But it is sufficient to twist only the last moving blades, and if necessary to provide the last fixed row with a slight simplified twist, and the advantage thus obtained is almost the same as if several or all the rows of blades were twisted.

If the drop to be converted by a group of stages has been predetermined, then, since the method of the invention reduces the drop of the last moving row, the rows preceding the last row must necessarily handle a drop which is greater by the amount of the reduction.

The discharge cross-section area of the rows in question is therefore made smaller by an amount corresponding to the smaller heat drop of the last moving row. The additional losses thus incurred, however, are much less than loss reduction in the last moving row and at the exit from the blading.

The flow discharge cross-section area of all the rows preceding the last row is reduced by reducing the ratio of passage width $q$ to blade pitch $t$, which is equivalent to reducing the flow angle, and/or by reducing the annular flow area, which means shortening the blades and changing one or both of the diameters defining the annular area.

Examples of the subject of the invention are shown in simplified form in the drawings, in which.

Figure 1:
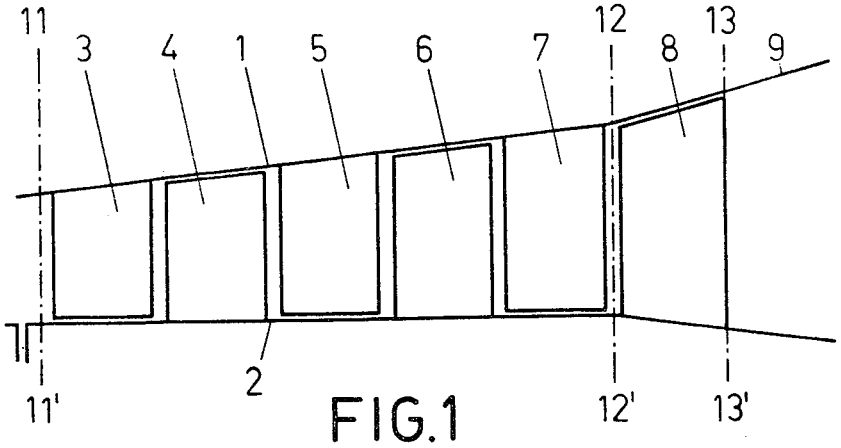
FIG. 1 is a longitudinal section through the flow passage of a turbine.

FIG. 1, which represents a three-stage turbine, shows the stator 1, rotor 2, fixed blades 3, 5 and 7, moving blades 4, 6 and 8, and diffuser 9. The line 11 — 11′ is a section prependicular to the machine axis before the first blade row, line 12 — 12′ is a section between the penultimate and last blade rows, and line 13 — 13′ is a section after the last row. From 11 — 11′ to 12 — 12′ the increase in flow cross-section area is equivalent to, or less than, the increase in volume of the flow medium. From 12 — 12′ to 13 — 13′ the flow discharge cross-section area from the last moving row increases more rapidly than would correspond to the increase in flow volume from the penultimate to the last moving blade row, this being achieved by lengthening the moving blades 8 and enlarging the annular flow area accordingly.

The principle will now be explained with reference to FIGS. 3 and 4.

Figure 3:
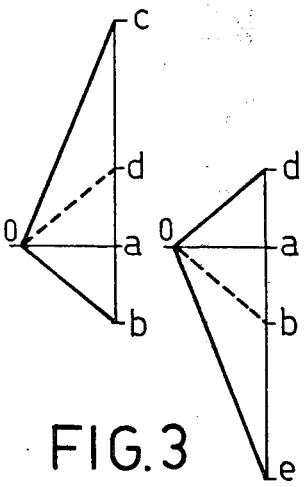

FIG. 3 shows the usual vector diagram of the velocities in one stage of a reaction turbine with symmetrically identical fixed and moving blades. $\overline{oa}$ is the axial flow component, it being assumed initially that this remains unchanged from one blade row to the next. $\overline{oa}$ is at the same time the approach velocity to the first fixed row. $\overline{oc}$ is the absolute velocity from the fixed blade rows, $\overline{od}$ is the same velocity relative to the moving blades. $\overline{oe}$ is the relative exit velocity from the moving rows. Its absolute value $\overline{ob}$ is at the same time inlet velocity to the following fixed rows.

Figure 4:
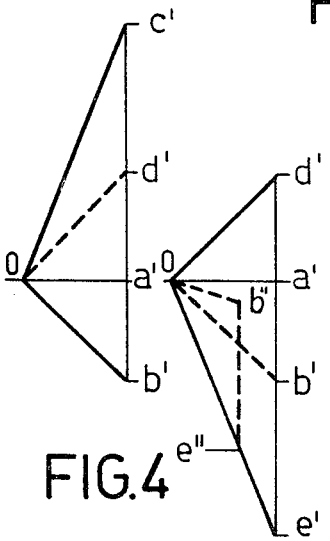

FIG. 4 shows the vector diagram of FIG. 3 as modified by the effect of the invention. The relative exit veloxity $\overline{oe}''$ from the last moving row in lower. The absolute velocity $\overline{ob}$ in FIG. 3 is reduced accordingly to $\overline{ob}''$. To be able to convert the predetermined total drop the velocities at all the rows preceding the last row rise from $\overline{oa}$ . . . $\overline{oe}$ in FIG. 3 to $\overline{oa}'$ . . . $\overline{oe}'$.

Figure 2:
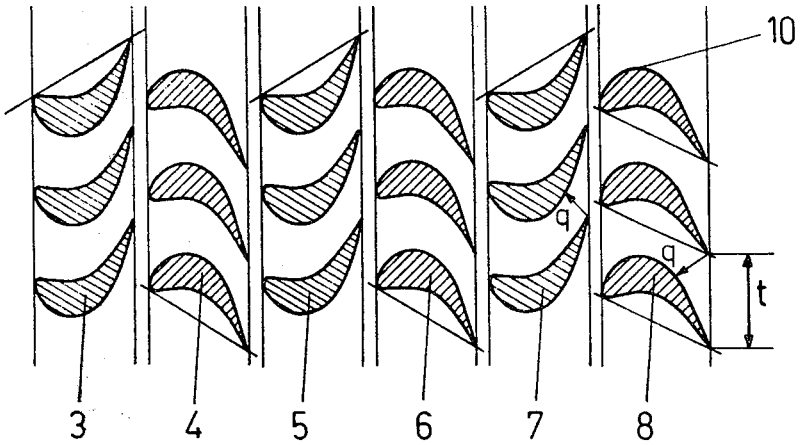
FIG. 2 is a blade diagram shown as the development of a cylindrical section through the flow passage of FIG. 1, FIGS. 3, 4, 5 are vector diagrams of the velocities to illustrate the effect of the invention.

In the blade diagram shown in FIG. 2 the parts are identified by the same reference numbers as in FIG. 1. The blade 8 has a sharply cambered profile 10 which allows large heat drops to be handled. For reasons for clarity, it is assumed that the blade pitch $t$ is the same for all the rows, and also that the flow passage width $q$ is the same for all rows except the last. The increase in cross-section area of the last moving row in accordance with the invention is achieved by enlarging the flow passage width $q$.

Figure 5:
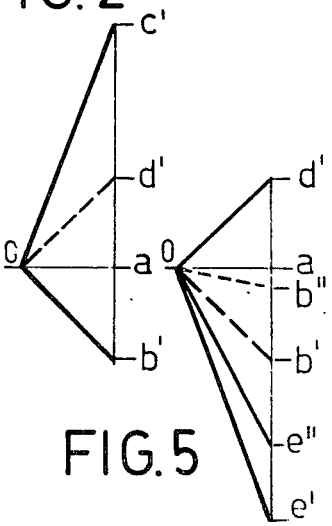

FIG. 5 shows the velocity diagram corresponding to the blade configuration represented by FIG. 2. The axial velocity $\overline{oa}$ remains the same between blade inlet and exit. Owing to the steps taken to retain the total heat drop, the velocities $\overline{ob}'$ . . . $\overline{oe}'$ are somewhat higher than $\overline{ob}$ . . . $\overline{oe}$ in FIG. 3. In the last moving row the relative velocity is reduced from $\overline{oe}$ in FIG. 3 to $\overline{oe}''$ owing to the enlarged flow passage. The absolute velocity $\overline{ob}''$ is reduced accordingly.

The blades can, of course, have any desired impuse or reaction profile in place of the profile 10 shown in FIG. 2.

In FIG. 2 the blade pitch $t$ is shown as the same for all blade rows, and flow passage width $q$ is shown as the same for all rows preceding the last row. As a variation of this, a configuration would be possible in which the blade pitch $t$ and/or the passage width $q$ are of different sizes for at least two stages or for at least two blade rows.

We claim:

1. In a turbine of axial construction through which an expanding gaseous working medium flows and which has more than two stages, each stage comprising one fixed blade row and one moving blade row, the improvement wherein the flow discharge cross-section area from only the last moving blade row is larger than the flow discharge cross-section of the penultimate moving blade row by an amount which is from 10 to 40% larger than the ratio of the increase in volume of the flow medium from the penultimate to the last moving blade row.

2. A turbine as claimed in claim 1, in which the flow discharge cross-section area of the last moving row is enlarged by increasing the ratio of passage width ($q$) to blade pitch ($t$).

3. A turbine as claimed in claim 2, in which the ratio of passage width ($q$) to blade pitch ($t$) varies over the length of the blades (8) of the last row in order to obtain a uniform velocity profile in the axial and tangential directions.

4. A turbine as claimed in claim 1, in which, in order to maintain a predetermined heat drop, the flow discharge cross-section area of all blade rows preceding the last row is made smaller by an amount corresponding to the reduction in heat drop of the last moving row brought about by enlarging its cross-section area.

5. A turbine as claimed in claim 4, in which the flow discharge cross-section of all rows preceding the last row is made smaller by decreasing the ratio of passage width ($q$) to blade pitch ($t$).

6. A turbine as claimed in claim 1, in which the flow discharge cross-section area of the last moving row is enlarged by increasing the annular flow area.

7. A turbine as claimed in claim 1, in which the flow discharge cross-section area of the last moving row is enlarged by increasing the ratio of passage width ($q$) to blade pitch ($t$) and by increasing the annular flow area.

* * * * *